US005467539A

United States Patent [19]

Hahn

[11] Patent Number: 5,467,539

[45] Date of Patent: Nov. 21, 1995

[54] REDUCING THE CONCENTRATION OF SOLVENT VAPORS IN DRYCLEANING MACHINES

[75] Inventor: Horst Hahn, Hackensack, N.J.

[73] Assignee: Multimatic Corporation, Northvale, N.J.

[21] Appl. No.: 229,530

[22] Filed: Apr. 19, 1994

[51] Int. Cl.[6] ..... F26B 21/06

[52] U.S. Cl. ..... 34/77; 34/78; 34/82

[58] Field of Search ..... 34/76, 77, 78, 34/79, 82, 467, 480

[56] References Cited

U.S. PATENT DOCUMENTS

| | | | |
|---|---|---|---|
| 3,104,936 | 9/1963 | Führing . | |
| 3,538,615 | 3/1968 | Führing et al. | 34/77 |
| 3,728,074 | 4/1973 | Victor . | |
| 4,083,704 | 4/1978 | Knopf . | |
| 4,459,831 | 7/1984 | Grandi . | |
| 4,788,776 | 12/1988 | Führing et al. | 34/76 |
| 4,850,119 | 7/1989 | Führing | 34/77 |
| 4,920,768 | 5/1990 | Cares et al. . | |
| 5,195,252 | 3/1993 | Yamada et al. . | |
| 5,213,594 | 5/1993 | Cannon et al. . | |

FOREIGN PATENT DOCUMENTS

| | | |
|---|---|---|
| 0462607A1 | 12/1991 | European Pat. Off. . |
| 3020579A1 | 12/1981 | Germany . |

*Primary Examiner*—Denise L. Gromada
*Assistant Examiner*—Susanne C. Tinker
*Attorney, Agent, or Firm*—Samuelson & Jacob

[57] ABSTRACT

Apparatus and method for reducing the concentration of solvent vapor in the drum of a drycleaning machine upon completion of a cleaning and drying operation, during which articles are cleaned in the drycleaning machine, the drycleaning machine being of the type having a drum, and a solvent recovery system communicating with the drum for recovering solvent from solvent-laden air circulated through the solvent recovery system and the drum during a drying and solvent recovery cycle, the apparatus and method including an arrangement for circulating solvent-laden air from the drum through the solvent recovery system during the drying and recovery cycle, and closing communication between the drum and the solvent recovery system during a post-recovery cycle, subsequent to the drying and recovery cycle, and then circulating solvent-laden air from the drum through an adsorption unit during the post-recovery cycle to reduce the concentration of solvent vapor in the drum to an acceptable level prior to accessing the drum for removal of the cleaned articles.

10 Claims, 1 Drawing Sheet

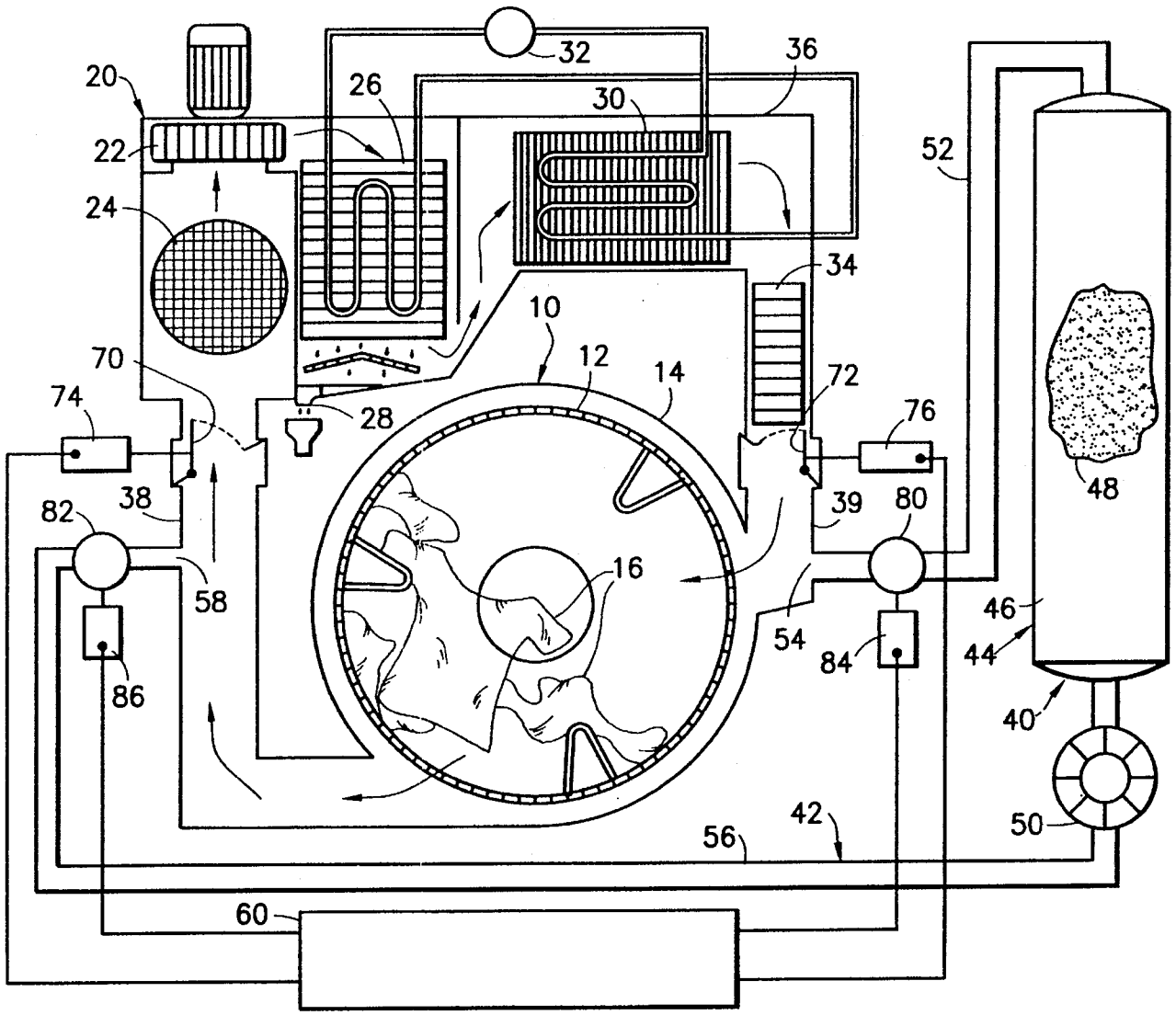
48
46
44
40
50
52
76
80
84
34
72
39
36
54
42
56
14
16
30
12
32
10
26
28
60
58
20
22
24
70
38
86
74
82

REDUCING THE CONCENTRATION OF SOLVENT VAPORS IN DRYCLEANING MACHINES

The present invention relates generally to drycleaning machines and pertains, more specifically, to the control of solvent vapors so as to reduce the concentration of solvent vapor in the drum of a drycleaning machine and consequently reduce the emanation of solvent vapors from the drycleaning machine.

Drycleaning machines utilizing solvents for cleaning clothing and other articles of textile materials generally employ a volatile solvent for cleaning, the most preferred solvent currently being perchlorethylene. These drycleaning machines usually include a drum which rotates within a drum chamber to tumble the articles to be cleaned as the machine is cycled through a cleaning cycle, during which the articles are immersed in the solvent, an extraction cycle, during which solvent is extracted from the articles for reuse, and then through a drying and solvent recovery cycle, during which further solvent is extracted from the articles and is recovered for reuse. Once the drying and recovery cycle is complete, the machine is opened to access the articles in the drum for removal. At that point, any residual solvent vapor in the drum can emanate into the environment in the vicinity of the machine.

In order to meet the more stringent standards currently being proposed for the concentration of solvent vapors in the drum of a drycleaning machine, it will become necessary to develop systems for dealing with such vapors so that the concentration is reduced to the very low levels permitted by the latest proposed regulations. Thus, whereas in present drycleaning machines concentrations of solvent vapor within the drum of the machine could reach about 1,500 to 2,000 ppm, proposed regulations call for concentrations of no more than 300 ppm.

The present invention provides apparatus and method for reducing the concentration of solvent vapors within the drum of a drycleaning machine so as to meet currently proposed standards for allowed concentrations of solvent vapor in the drum of such machines. As such, the present invention attains several objects and advantages, some of which are summarized as follows: Reduces the concentration of solvent vapors in the drum of a drycleaning machine to acceptable levels for increased safety in the operation of such machines; enables modification of existing drycleaning machine designs, without requiring extensive redesign, to accommodate the latest proposed requirements for low concentrations of solvent vapor; provides an economical apparatus and method for reducing solvent vapors to acceptable, safe levels of concentration for ready incorporation into drycleaning plants; enables the establishment of a safer environment in the workplace and in areas surrounding drycleaning machine installations; promotes the use of drycleaning machines in installations previously unavailable to such machines because of the possibility of contamination of the atmosphere with emanating solvent vapors; enables safer, long-term operation of drycleaning machines without requiring elaborate external measures which might otherwise be necessary in order to deal with emanating solvent vapors.

The above objects and advantages, as well as further objects and advantages, are attained by the present invention which may be described briefly as apparatus and method for reducing the concentration of solvent vapors in the drum of a drycleaning machine upon completion of a cleaning and drying operation, the drycleaning machine being of the type having a drum, and a solvent recovery system communicating with the drum for recovering solvent from solvent-laden air circulated through the solvent recovery system and the drum during a drying and solvent recovery cycle, the apparatus and method comprising: means for and the step of circulating solvent-laden air from the drum through the solvent recovery system during the drying and recovery cycle; means for and the step of closing communication between the drum and the solvent recovery system during a post-recovery cycle, subsequent to the drying and recovery cycle; and means for and the step of circulating solvent-laden air from the drum through separate filtering means during the post-recovery cycle to reduce to a minimum the concentration of solvent vapor in the drum.

The invention will be understood more fully, while still further objects and advantages will become apparent, in the following detailed description of preferred embodiments of the invention illustrated in the accompanying drawing, in which the apparatus and method of the present invention are shown in schematic form.

Referring now to the drawing, a drycleaning machine is shown schematically at 10 and is seen to include drum 12 which rotates within a drum chamber 14 to tumble clothing, or other textile articles, shown at 16, for the purpose of cleaning the articles 16. A cleaning solvent, such as perchlorethylene, is introduced into the drum 12 for immersion of the articles 16 in the solvent for cleaning during a cleaning cycle of operation. Upon completion of the cleaning cycle, the machine 10 is operated through an extraction cycle and then through a drying and solvent recovery cycle of operation, during which drying and recovery cycle further solvent is extracted for reuse, all as now well-known in the art of drycleaning machines.

During the drying and recovery cycle, air is circulated from the drum 12 and drum chamber 14 through a solvent recovery system, shown at 20. Solvent-laden air is driven by a fan 22 through a lint filter 24 to a refrigerated air cooler 26 where the solvent is condensed, and the condensed solvent is drained through a drain 28 for recovery and reuse. The air continues to a heater 30 which receives heat from a refrigeration compressor 32. The heated air then passes through an auxiliary heater 34 which heats the air, for a relatively short time, to prepare the air for further drying of the articles 16 in the drum 12. The solvent recovery system 20 includes a housing 36, within which the above-described components are housed, and a first duct 38 extends between the drum chamber 14 and the housing 36 to conduct the solvent-laden air to the components of the solvent recovery system 20, while a second duct 39 extends between the housing 36 and the drum chamber 14 to conduct the heated air back to the drum chamber 14 to be passed to the drum 12.

The solvent recovery system 20 reduces the concentration of solvent vapor in the drum 12; however, the concentration of solvent vapor, even after the maximum reduction of concentration, still will remain at a level higher than that required by the latest proposed regulations. Typically, where the solvent is perchlorethylene, the concentration of solvent vapor remaining after completion of the full drying and recovery cycle will be about 1,500 to 2,000 ppm. While it may be possible to attain lower concentrations of solvent vapor, the relatively large volume of the interior of the housing 36 requires the movement of corresponding large volumes of solvent-laden air through the solvent recovery system 20, and an inordinate length of time would be necessary for the attainment of such lower concentrations.

In order to further reduce the concentration of solvent vapor in the drum chamber 14, and in the drum 12 itself, and to do so in a relatively short time, the present invention provides a filtering means in the form of an external adsorption unit 40 which communicates with the drum chamber 14 in such a way as to selectively pass solvent-laden air through the adsorption unit 40. The volume of the solvent-laden air passed to the adsorption unit 40 is limited so that solvent vapor is removed very quickly from the air circulated through the drum chamber 14, and the drum 12, and the concentration of solvent vapor is reduced dramatically in a very short time. To this end, circulating means 42 is provided for bringing the solvent-laden air from the drum chamber 14 to an adsorption means 44, where the solvent is adsorbed for removal from the air, and for then returning the air to the drum chamber 14 and drum 12. The adsorption means 44 includes a canister 46 within which is placed an adsorbent 48, preferably in the form of activated carbon. A pump 50 draws the solvent-laden air through a first, or inlet conduit 52 which communicates with the drum chamber 14, and the drum 12, at a first location 54, and moves the cleaner air from the adsorption means 44 back to the drum chamber 14, and to the drum 12, through a second, or outlet conduit 56 which communicates with the drum chamber 14 at a second location 58.

Valving means are operated by a controller 60 to close off the solvent recovery system 20 from the drum chamber 14 during a post-recovery cycle of operation, so that during the post-recovery cycle only the smaller volume of air is circulated between the drum chamber 14 and the adsorption means 44. Further, any residual solvent remaining within the solvent recovery system 20, as by some accumulation in any of the components of the solvent recovery system 20 contacted by the solvent-laden air previously passed through the solvent recovery system 20, will not affect the concentration of solvent vapor in the air circulated between the drum chamber 14 and the adsorption means 44, since that solvent will be isolated from the air circuit through the adsorption means 44. In this manner, the adsorption means 44 is able to very quickly reduce the concentration of solvent vapor in the drum 12 to acceptable levels. Typically, where the solvent is perchlorethylene, the level of concentration of solvent vapor is reduced to about 300 ppm in about five to six minutes.

To this end, the valving means include first valving means in the form of a first damper 70 in the first duct 38 and a second damper 72 in the second duct 39. Each damper 70 and 72 is actuated by a corresponding damper actuator 74 and 76, respectively, to selectively open or close the corresponding duct 38 and 39. The valving means further includes second valving means in the form of a first valve 80 in the first conduit 52 and a second valve 82 in the second conduit 56. Each valve 80 and 82 is actuated by a corresponding valve actuator 84 and 86, respectively, to selectively open or close the corresponding conduit 52 and 56. For the drying and recovery cycle of operation, the controller 60 operates the damper actuators 74 and 76, and the corresponding dampers 70 and 72, to open the ducts 38 and 39, and operates the valve actuators 84 and 86, and the corresponding valves 80 and 82, to close the conduits 52 and 56. Thus, during the drying and recovery cycle of operation, relatively larger volumes of air are moved through the solvent recovery system 20, while no air is moved through the adsorption unit 40.

Upon completion of the drying and recovery cycle, the controller 60 operates the damper actuators 74 and 76, and the corresponding dampers 70 and 72, to close the ducts 38 and 39, and operates the valve actuators 84 and 86, and the corresponding valves 80 and 82, to open the conduits 52 and 56, so that during the post-recovery cycle of operation, only a smaller volume of solvent-laden air, that is, only the smaller volume determined by the size of the drum 12, and the drum chamber 14, is circulated via the circulating means 42 through the adsorption unit 40 to very quickly reduce the concentration of solvent vapors in the drum chamber 14, and in the drum 12. Once the concentration of solvent vapors is reduced to the desired low level, the drum 12 may be accessed and the articles 16 may be removed from the drum 12 without releasing undue amounts of solvent vapor into the environment immediately adjacent the drycleaning machine 10.

It will be seen that the present invention attains the objects and advantages summarized above, namely: Reduces the concentration of solvent vapors in the drum of a drycleaning machine to acceptable levels for increased safety in the operation of such machines; Enables modification of existing drycleaning machine designs, without requiring extensive redesign, to accommodate the latest proposed requirements for low concentrations of solvent vapor; provides an economical apparatus and method for reducing solvent vapors to acceptable, safe levels of concentration for ready incorporation into drycleaning plants; enables the establishment of a safer environment in the workplace and in areas surrounding drycleaning machine installations; promotes the use of drycleaning machines in installations previously unavailable to such machines because of the possibility of contamination of the atmosphere with emanating solvent vapors; enables safer, long-term operation of drycleaning machines without requiring elaborate external measures which might otherwise be necessary in order to deal with emanating solvent vapors.

It is to be understood that the above detailed description of a preferred embodiments of the invention is provided by way of example only. Various details of design, construction and procedure may be modified without departing from the true spirit and scope of the invention, as set forth in the appended claims.

The embodiments of the inventions in which an exclusive property or privilege is claimed are defined as follows:

1. Apparatus for reducing the concentration of solvent vapor in the drum of a drycleaning machine upon completion of a cleaning and drying operation, the drycleaning machine being of the type having a drum, and a solvent recovery system communicating with the drum, the solvent recovery system including a fan for circulating solvent-laden air through the solvent recovery system and the drum during a drying and solvent recovery cycle to remove solvent from the solvent-laden air, the apparatus comprising:

filtering means for filtering solvent from solvent-laden air, the filtering means including adsorption means for adsorbing solvent from the solvent-laden air, and circulating means for circulating solvent-laden air from the drum through the adsorbing means;

first valving means between the solvent recovery system and the drum;

second valving means between the filtering means and the drum;

control means for operating the first valving means and the second valving means to circulate solvent-laden air from the drum through the solvent recovery system during the drying and recovery cycle, and to close communication between the drum and the solvent recovery system, including the fan of the solvent recovery system, during a post-recovery cycle, to isolate the drum from the solvent recovery system, including the fan of the solvent recovery system, subsequent to the drying and recovery cycle, and circulate solvent-laden air from the drum through the filtering means during the post-recovery cycle, while the solvent recovery system, including the fan of the solvent recovery system, is maintained isolated from the drum and the filtering means, to reduce to a minimum the concentration of solvent vapor in the drum.

2. The invention of claim 1 wherein the adsorption means includes an activated carbon adsorbent.

3. The invention of claim 1 wherein the drycleaning machine includes a drum chamber within which the drum is located, and the apparatus includes circulating means for circulating solvent-laden air from the drum chamber through the filter means, and the first valving means selectively opens and closes communication between the solvent recovery system and the drum chamber;

the second valving means selectively opens and closes communication between the circulating means and the drum chamber; and the control means operates the first valving means to open communication between the solvent recovery system and the drum chamber to circulate solvent-laden air from the drum chamber through the solvent recovery system during the drying and recovery cycle and to close communication between the drum chamber and the solvent recovery system subsequent to the drying and recovery cycle, and operates the second valving means to close communication between the circulating means and the drum chamber during the drying and recovery cycle and to open communication between the circulating means and the drum chamber during the post-recovery cycle, subsequent to the drying and recovery cycle, to circulate solvent-laden air from the drum chamber through the filter means during the post-recovery cycle.

4. The invention of claim 3 wherein the drycleaning machine includes a first duct extending from the drum chamber to the solvent recovery system and a second duct extending from the solvent recovery system to the drum chamber, and the first valving means includes a first damper in the first duct and a second damper in the second duct.

5. The invention of claim 4 wherein:

the circulating means includes a first conduit extending from a first location, between the drum chamber and the first damper, to the filter means; and a second conduit extending from the filter means to a second location, between the drum chamber and the second damper; and the second valving means includes a first valve for selectively opening and closing the first conduit; and a second valve for selectively opening and closing the second conduit.

6. The invention of claim 5 wherein the adsorption means includes an activated carbon adsorbent.

7. The method for reducing the concentration of solvent vapor in the drum of a drycleaning machine upon completion of a cleaning and drying operation, the drycleaning machine being of the type having a drum, and a solvent recovery system communicating with the drum, the solvent recovery system including a fan for circulating solvent-laden air through the solvent recovery system and the drum during a drying and solvent recovery cycle to recover solvent from the solvent-laden air, the method comprising:

circulating solvent-laden air from the drum through the solvent recovery system, including the fan of the solvent recovery system, during the drying and recovery cycle;

then closing communication between the drum and the solvent recovery system, including the fan of the solvent recovery system, during a post-recovery cycle, to isolate the drum from the solvent recovery system, including the fan of the solvent recovery system, subsequent to the drying and recovery cycle; and then circulating solvent-laden air from the drum through separate filtering means during the post-recovery cycle, while the solvent recovery system, including the fan of the solvent recovery system, is maintained isolated from the drum and the separate filtering means.

8. The invention of claim 7 including adsorbing solvent from the solvent-laden air as the solvent-laden air is circulated from the drum through the filtering means.

9. The invention of claim 8 wherein the solvent is adsorbed with an activated carbon adsorbent.

10. The invention of claim 7 wherein the concentration of solvent vapor in the drum is reduced to no more than about 300 ppm.

* * * * *